United States Patent [19]

Niemiro et al.

[11] Patent Number: 4,493,690

[45] Date of Patent: Jan. 15, 1985

[54] CAM ACTIVATED ANTI-DOG-EAR DEVICE

[75] Inventors: Josef W. Niemiro, Berwyn; Eugene Skipor, Elmwood Park, both of Ill.

[73] Assignee: Rockwell International Corporation, Pittsburgh, Pa.

[21] Appl. No.: 459,563

[22] Filed: Jan. 20, 1983

[51] Int. Cl.[3] ..... B65H 45/18

[52] U.S. Cl. ..... 493/444; 493/445; 493/454

[58] Field of Search ..... 493/406, 410, 416, 417, 493/421, 426, 427, 431, 435, 439, 440, 442, 443, 444, 445, 454

[56] References Cited

U.S. PATENT DOCUMENTS

| | | | |
|---|---|---|---|
| 2,985,449 | 5/1961 | Dietrich | 493/431 |
| 4,053,150 | 10/1977 | Lane | 493/444 |
| 4,279,410 | 7/1981 | Bolza-Schünemann | 493/427 |
| 4,419,088 | 12/1983 | Nemec | 493/444 |

FOREIGN PATENT DOCUMENTS

| | | | |
|---|---|---|---|
| 2837392 | 2/1980 | Fed. Rep. of Germany | 493/443 |

*Primary Examiner*—E. Michael Combs
*Assistant Examiner*—Charles Rosenberg

[57] ABSTRACT

This invention provides an apparatus for quarter folding sheet products such as newspapers and the like, which includes a pair of cooperating fold rolls, a sheet supporting surface above the fold rolls, a rotatable cage assembly carrying a tucker blade that tucks a sheet into the nip of the fold rolls during each revolution of the fold rolls, a pressing device for exerting a force against one group of the ends of the product being folded and cam device operating the pressing device in timed relationship with the tucking of a sheet product into the fold rolls.

10 Claims, 3 Drawing Figures

CAM ACTIVATED ANTI-DOG-EAR DEVICE

BACKGROUND OF THE INVENTION

The present invention relates to an improved apparatus for quarter folding a newspaper that has already been shaped into the conventional half-folded form. Specifically, the apparatus includes means associated with the tucker blade assembly that is moved downwardly by cam means into restraining contact with the free or loose edges of a half-folded newspaper product as it is being drawn through the rolls of a quarter folder.

The production of folded articles such as newspapers or the like generally comprises printing the desired subject matter on a travelling web, running the web over a former to fold it in the longitudinal direction and then subsequently cutting the lengthwise folded material into pieces of the appropriate length. These cut pieces are then half folded by suitable folder and delivered to a conveyor belt in the standard newspaper configuration size. By "standard newspaper size," it is meant the half-folded product in which the newspaper has two folded edges and two cut edges, the one folded edge being transverse to the length of the newspaper about midway between the ends thereof and the other folded edge extending along the lefthand longitudinal side of the newspaper. The two extremities and the other longitudinal edge are of course free, with the two transverse free ends being adjacent to each other because of the longitudinal center fold. While this configuration constitutes the larger proportion of newspaper production, in many instances, it is desired to again fold the already half-folded product, this being referred to as quarter folding, to produce an article of tabloid size. If a tabloid is to be produced, then a further cut must be made to free specific folded edges. However, in some cases, the half-folded product is quarter folded merely for mailing or other handling purposes.

In the past, during the quarter folding operation, it was found that when the folded edges are brought into contact with the free edges, the free edges bounce or fly away and then are folded back on themselves as they go through the fold rolls, thereby producing what are known as "dog-ears." In those instances where mailing is the cause for the product to be quarter folded, it often occurs that the dog-ears are located at the site where automatic equipment attaches mailing tags or labels, this constituting a handling problem.

The problem of dog-ears occuring during folding operations in the production of newsprint is recognized in the art and two proposals for reducing the severity of the dog-ear effect can be found in U.S. Pat. Nos. 2,160,198 and 4,053,150.

It is a principal object of this invention to provide a simple yet effective apparatus for reducing the occurrence of dog-ears in quarter-folded products such as newspapers and the like.

It is an additional object of this invention to provide an attachment to the existing tucker blade apparatus or to the shaft carrying this apparatus that contacts the loose edges of the newspaper as it is drawn through the fold rolls so that these ends of the newspaper will not be allowed to fly against the other half of the paper.

BRIEF DESCRIPTION OF THE DRAWINGS

Other objects and advantages of this invention will be in part obvious and in part explained in reference to the accompanying specification and drawings in which.

DESCRIPTION OF THE PREFERRED EMBODIMENT

Figure 1:
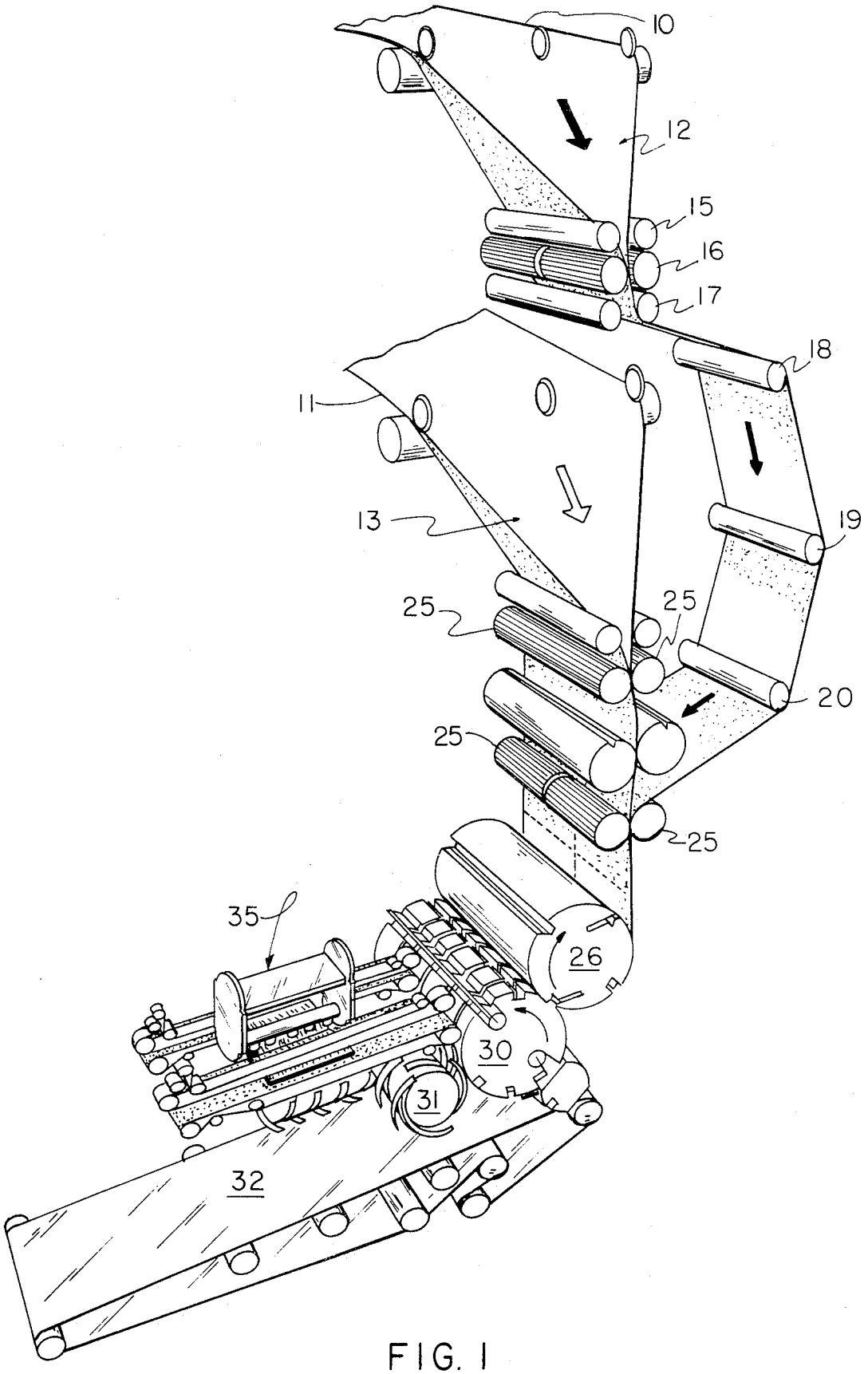
FIG. 1 is a schematic perspective showing the manner in which web newsprint arrives from the print, is cut, half folded, and then quarter folded for delivery toward the mailroom.

The general manner in which printed web is converted into folded-sheet product can best be seen by referring to FIG. 1 where, in the upper portion, two webs are shown approaching the formers and then being cut and either half or quarter folded for final delivery.

Referring more particularly to this drawing, it will be seen that travelling webs 10 and 11 travel over the upper former 12 and former 13, respectively. When travelling over the formers, the web is folded on back on itself so that it has two loose edges and one folded edge and now consists of a two-ply material. Following the path of the web 10 from the upper former 12, it will be seen that it passes through upper forming rollers 15, upper nipping rollers 16, idler roller 17, compensating roller 18, idler rollers 19 and 20, and finally, into the nipping rollers 25. From the nipping rollers 25, the sheet is fed downwardly around the cutting cylinder 26 which is of conventional design and is then cut into lengths which are usual in the production of newsprint. The paper having been cut by cylinder 26 is then seized in its middle by the half-fold jaw cylinder 30 which produces a single center fold in the newsprint that extends laterally of the length of the sheet. In this configuration, the newspaper thus produced has a folded edge in the center running transversely and also one folded edge along the lefthand side of the product. If this form of fold is to be the final one, as it would be for most daily newspapers, then the article is released into the half-fold delivery fly 31 which then deposits the successful half-folded products onto delivery belt 32 so that the printed newspapers are in shingled, overlapping or imbricated position.

If the newsprint is to be quarter folded for the production of a tabloid or for mailing purposes, then the mechanism will be so arranged that the paper rather than being delivered to the half-fold delivery fly 31, will be delivered to the quarter folder 35.

Figure 2:
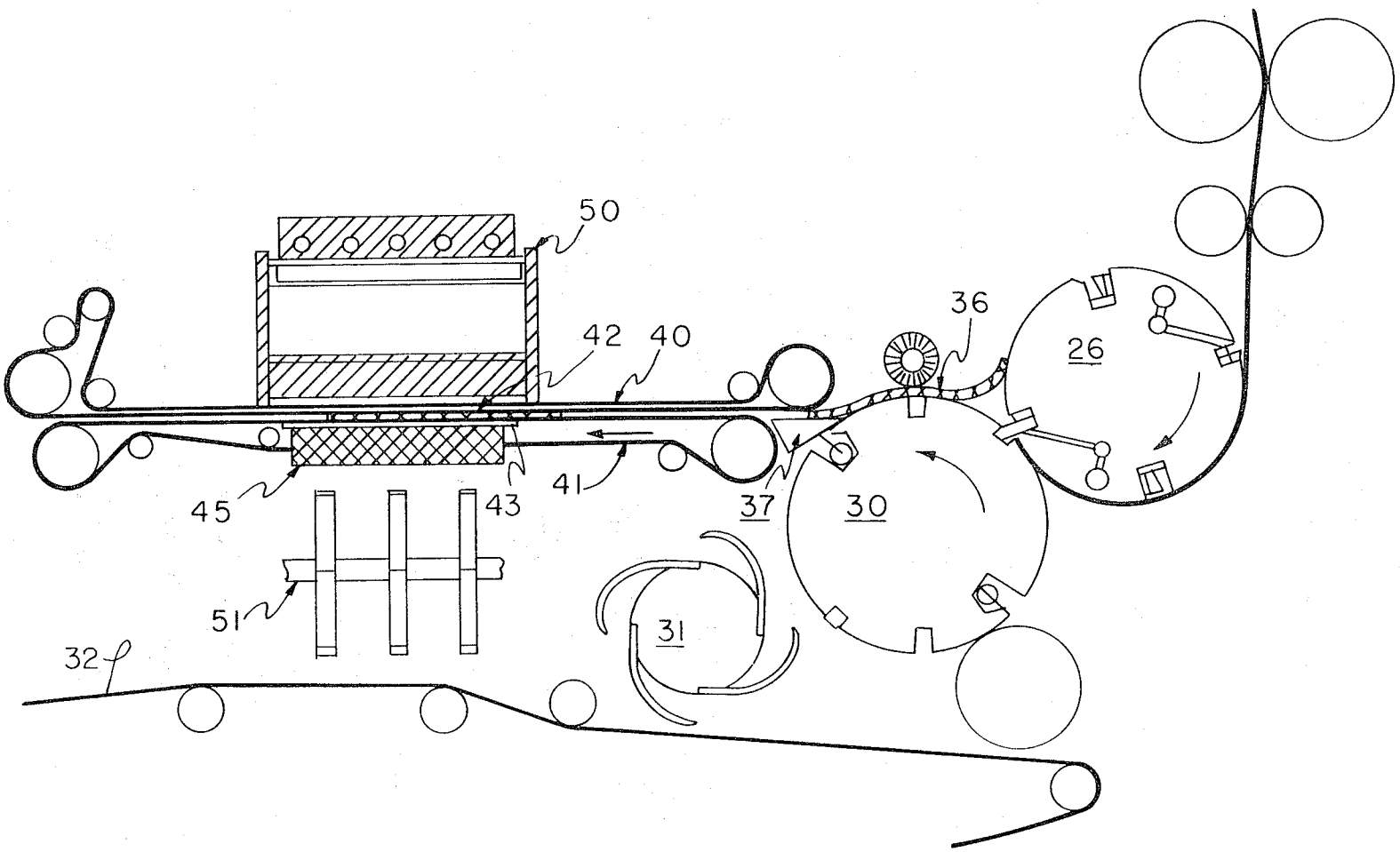
FIG. 2 is a schematic side elevation showing the cutter roll, half-fold roll, and the quarter-fold apparatus together with the half-fold delivery fly and exit conveyor.

For a better understanding of the apparatus as the newspaper product approaches the quarter fold, reference is made to FIG. 2 of the drawings. In this FIG. 2, the numeral 26 is the cutting cylinder which was referred to in connection with FIG. 1 and the numeral 30 designates the half-fold jaw cylinder. In the configuration here shown, the half-fold delivery fly is not used but, instead, the half-folded newsprint 36 exits across the stripper shoe 37 where it is advanced between the opposing endless belts 40 and 41. The endless feed belts 40 and 41 advance each successive half-folded paper 36 toward the quarter-folding zone 42 and newspaper support table 43 which is located above the fold rollers 45 and below the tucker blade assembly 50. The table 43 is provided with a slot 44 through which each successive newspaper is pushed by the tucker blade referred to hereafter. The numeral 51 designates the quarter-fold fly which takes the quarter-folded product and delivers it onto the conveyor system 32.

Figure 3:
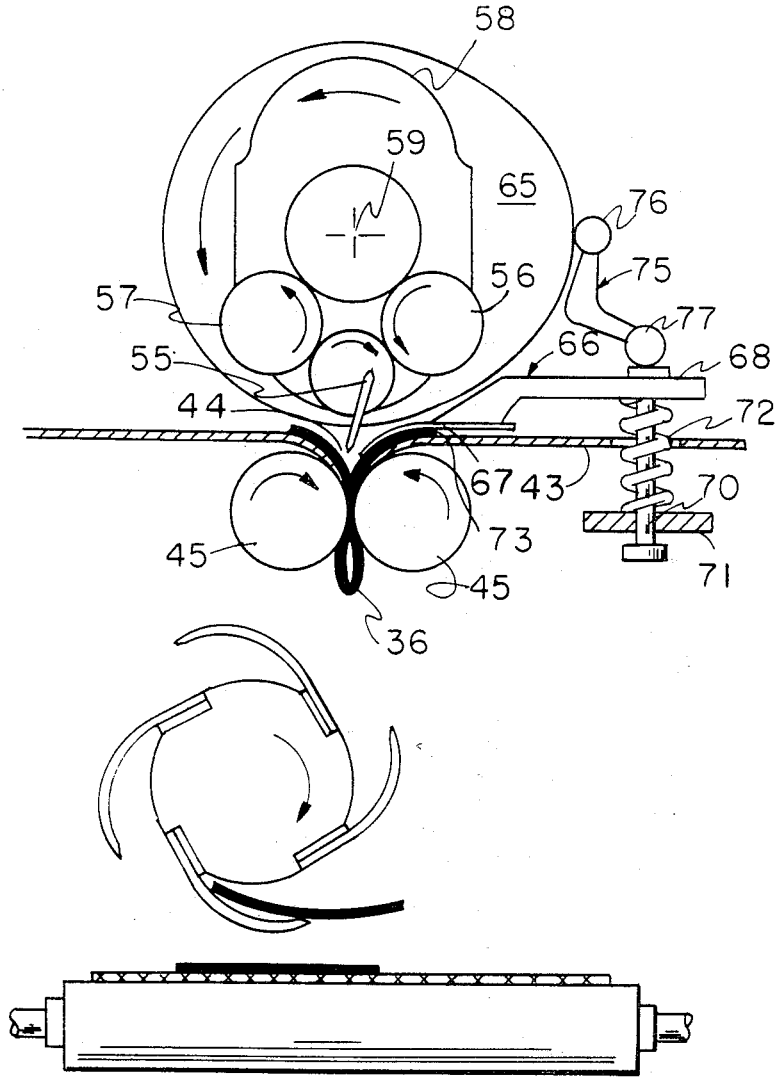
FIG. 3 is a somewhat schematic end elevation showing the tucker blade cage carrying the device which restrains the free edges of the newspaper during at least a portion of the quarter-folding operation.

Referring to the FIG. 3 of the drawings, the tucker blade assembly 50 comprises a tucker blade 55 which is carried on an element which meshes with a pair of related gear elements 56 and 57 so that upon rotation of the cage 58 about axis 59, the blade will move between an extended position, such as that shown in FIG. 3, to an inverted or internal position after 90° rotation of the cage, and again, to an exterior position when the cage has travelled 180°. No tucking is performed when the blade is in its upper position but that is of no particular consequence.

To understand the mechanism of the present invention whereby the formation of dog-ears are prevented during the quarter folding of a newspaper product, reference is made to FIG. 3 of the drawings. Here it can be seen that there is provided a cam means 65 that is mounted for rotation about the same axis 59 that is the axis of rotation for cage 58. Cam means 65 can be carried either directly on the shaft having axis 59 or can be attached to the cage since it has the same axis of rotation. To the lower right of cam means 65, as viewed in FIG. 3, and immediately above the table 43 is a presser means 66. Presser means 66 comprises a face portion 67 which overlies the surface of the supporting table 43 in the area immediately adjacent to the slot 44 of table 43. Since the table in the vicinity of the slot 44 has a downwardly turned lip, the face portion 67 of presser means 66 is also provided with a downward curvature so that the relative distance between the face area 67 and the table is constant throughout the entire area of the face portion 67. Presser means 66 also has an elongated arm 68 that extends away from the face portion in a direction away from the slot 44 in supporting table 43.

The outer end of the elongated arm receives a vertically extending tie rod 70 that extends through table 43 and also through a bracket that is secured to the frame of a bracket 71 that is secured to the frame of the machine (the frame not being shown). Surrounding the intermediate portion of retaining pin 70 is a helical compression spring 72 that exerts a continuous upward force against the elongated arm 68 thereby normally urging the presser means 66 toward a position in which the face portion 67 would be at its most removed location with respect to the table 43.

Downward movement of the presser means 66 toward table 43 is accomplished by means of a connecting link between cam 65 and a bearing surface provided on the upper end of connecting pin 70. Specifically, as shown in FIG. 3, there is provided a bell crank lever 75 that has rollers 76 and 77 provided on each end. The roller 76 is in contact with the periphery of cam 65 while the roller 77 is in contact with the bearing surface provided on the upper end of retaining 70. It is apparent that as the cam 65 rotates, the bell crank lever will tilt during the rotation thereby forcing the connecting pin 70 downwardly and this in turn causing the downward movement of presser means 66. In view of the fact that the cam is mounted on the same shaft or attached to the tucker cage assembly, the movement of the presser means will coincide with the action by the tucker blade 55 to introduce a newspaper into the nip of the fold rolls 45. Again, as shown in FIG. 3, it will be seen that the presser means 66 is in its downward position and is engaging the loose or free edges 73 of the newspaper 36. It will be appreciated of course that it is not necessary that the presser means engage that side of the paper that has the loose edges but this is the preferred method of operation since it is the loose edges that normally cause the dog-ear problem when one or more double back upon impact with the folded edges on the other side of the folded product.

Although the present invention has been described in connection with preferred embodiments, it is to be understood that modifications and variations may be resorted to without departing from the spirit and scope of the invention as those skilled in the art can readily understand. Such modifications and variations are considered to be within the purview and scope of the invention and the appended claims.

What we claim is:

1. In an apparatus for quarter folding a half-folded newspaper having folded edges along two sides thereof and loose edges along the remaining two sides thereof, which apparatus includes:

a pair of cooperating fold rolls; a surface located above the fold rolls to receive half-folded newspapers, the surface having a slot through which a newspaper can be moved;

a cage assembly mounted on a shaft for rotation above the newspaper supporting surface;

a tucker blade carried on the rotating cage and movable to tuck a newspaper through the slot in the supporting surface during each revolution of the cage assembly, the combination comprising:

cam means mounted for rotation with the shaft carrying the cage assembly; presser means having a face portion overlaying the surface of the newspaper supporting table immediately adjacent the slot in the table; and means operably connecting said cage assembly shaft means to said presser means whereby said face portion can be moved toward the supporting table to contact the loose edges of each newspaper when it is being drawn downwardly by the fold rolls.

2. An apparatus as defined in claim 1 wherein said presser means comprises a face portion and an elongated arm that extends from said face portion in a direction away from the slot in the supporting table.

3. An apparatus so defined in claim 1 wherein said apparatus includes means biasing said presser means away from the surface of the supporting table.

4. An apparatus as defined in claim 1 wherein said cam means is secured to the cage assembly.

5. An apparatus as defined in claim 1 wherein said means operably connecting said cam means to said presser means comprises lever means.

6. An apparatus as defined in claim 5 wherein said lever means comprises a bell crank lever having rotable elements on each end for contact with said cam means and with said presser means.

7. In an apparatus for quarter folding a half-folded newspaper having folded edges along two sides thereof and loose edges along the remaining two sides thereof, which apparatus includes:

a pair of cooperating fold rolls; a surface located above the fold rolls to receive half-folded newspapers, the surface having a slot through which a newspaper can be moved;

a cage assembly mounted on a shaft for rotation above the newspaper supporting surface;

a tucker blade carried on the rotating cage and movable to tuck a newspaper through the slot in the supporting surface during each revolution of the cage assembly, the assembly comprising:

presser means having a face portion overlaying the surface of the table immediately adjacent the slot in the table; and means operably connected to said presser means for moving said presser means between an upper inactive position and a lower active position where it contacts the loose edges of teach newspaper when it is being drawn downwardly the fold rolls.

8. An apparatus as defined in claim 7 wherein said presser moving means includes means continually biasing said presser means toward the upper inactive position and means operated by the shaft carrying the cage means to move said presser means to the lower active position in timed relationship with respect to the downward movement of a newspaper by the fold rolls.

9. An apparatus as defined in claim 8 wherein said means operated by the shaft carrying the cage comprises a cam and a lever operated by said cam to move said presser means downwardly against the face of said upward biasing means.

10. An apparatus as defined in claim 8 wherein biasing means is a spring.

* * * * *